US012416203B2

(12) United States Patent
Condon et al.

(10) Patent No.: US 12,416,203 B2
(45) Date of Patent: Sep. 16, 2025

(54) CASING DRIVER AND METHOD

(71) Applicant: Condon-Johnson & Associates, Inc., Oakland, CA (US)

(72) Inventors: Jeremy Condon, Oakland, CA (US); George Burrough, Oakland, CA (US)

(73) Assignee: Condon-Johnson & Associates, Inc., Oakland, CA (US)

( * ) Notice: Subject to any disclaimer, the term of this patent is extended or adjusted under 35 U.S.C. 154(b) by 241 days.

(21) Appl. No.: 18/325,416

(22) Filed: May 30, 2023

(65) Prior Publication Data

US 2024/0401411 A1 Dec. 5, 2024

(51) Int. Cl.

| | |
|---|---|
| ***E21B 7/20*** | (2006.01) |
| ***E02D 5/34*** | (2006.01) |
| ***E21B 7/02*** | (2006.01) |

(52) U.S. Cl.

CPC ..... *E21B 7/20* (2013.01); *E02D 5/34* (2013.01); *E21B 7/02* (2013.01)

(58) Field of Classification Search

CPC ..... E21B 7/20; E21B 7/02; E21B 6/00; E02D 7/02; E02D 7/06; E02D 7/08; E02D 7/10

See application file for complete search history.

(56) References Cited

U.S. PATENT DOCUMENTS

| | | | | |
|---|---|---|---|---|
| 10,883,312 | B2 * | 1/2021 | McMillan | E21B 6/06 |
| 2017/0074355 | A1 * | 3/2017 | Rayner | E21B 3/02 |

* cited by examiner

*Primary Examiner* — Sean D Andrish

(74) *Attorney, Agent, or Firm* — Dergosits & Noah LLP; Todd A. Noah

(57) ABSTRACT

An apparatus and method are provided for using a rotary drive of a drilling rig to drive both the drill stem and the casing simultaneously, by connecting the drill stem to the casing using a drive head. Subsequently, after drilling a first length of bore, the drive head may be removed and the drill stem driven by the rotary drive independently from the casing, allowing the bore to be extended further without moving the casing.

18 Claims, 21 Drawing Sheets

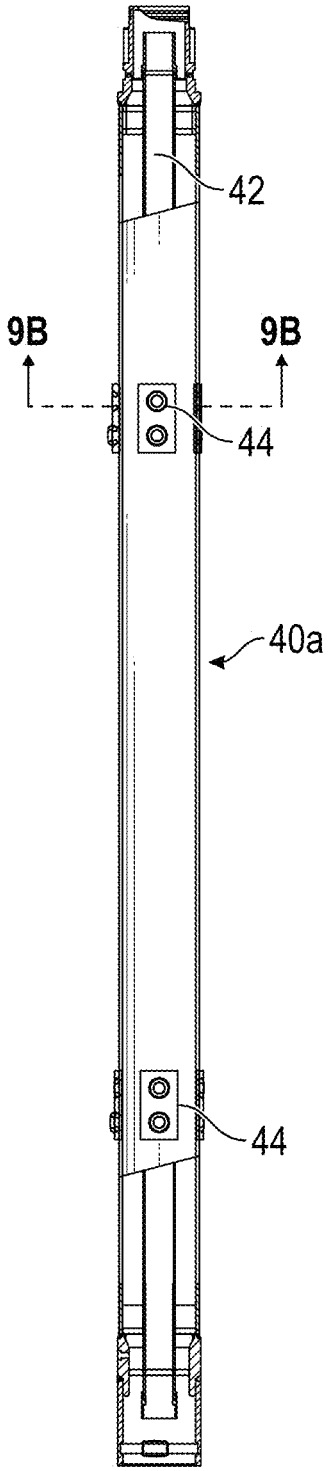
FIG. 9A
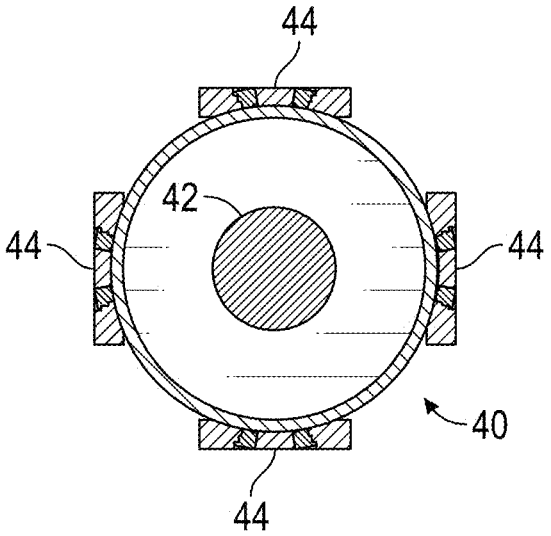
FIG. 9B
FIG. 9

CASING DRIVER AND METHOD

BACKGROUND

Typically, when using a drilling rig for partially cased auger cast or auger cast displacement piles, the drilling rig rotary drive is connected directly to both the drill stem and the casing. Casing is used as required over the drill tool as the drilled hole is advanced through a first layer and not needed for subsequent layers. This typical connection of the casing to the rotary drive limits pile depth beyond the tip of the casing to the length of the drill stem that extends above the rotary.

Thus, what is needed is an apparatus and method which accommodate the use of casings having different lengths on a full length drill stem by connecting the casing drive to the drill string, below the rotary, which enables the drilling rig to achieve its maximum drilling depth with shorter lengths of casing. The limitation of the typical connection is thereby removed.

BRIEF DESCRIPTION OF THE DRAWINGS

The embodiments are illustrated by way of example and not limitation in the accompanying drawings, in which like references indicate similar elements, and in which:

FIG. 9A is a side view of aspects of the first embodiment of a casing driver;

FIG. 9B is a top view of the section indicated in FIG. 8A;

DETAILED DESCRIPTION

Figure 1:
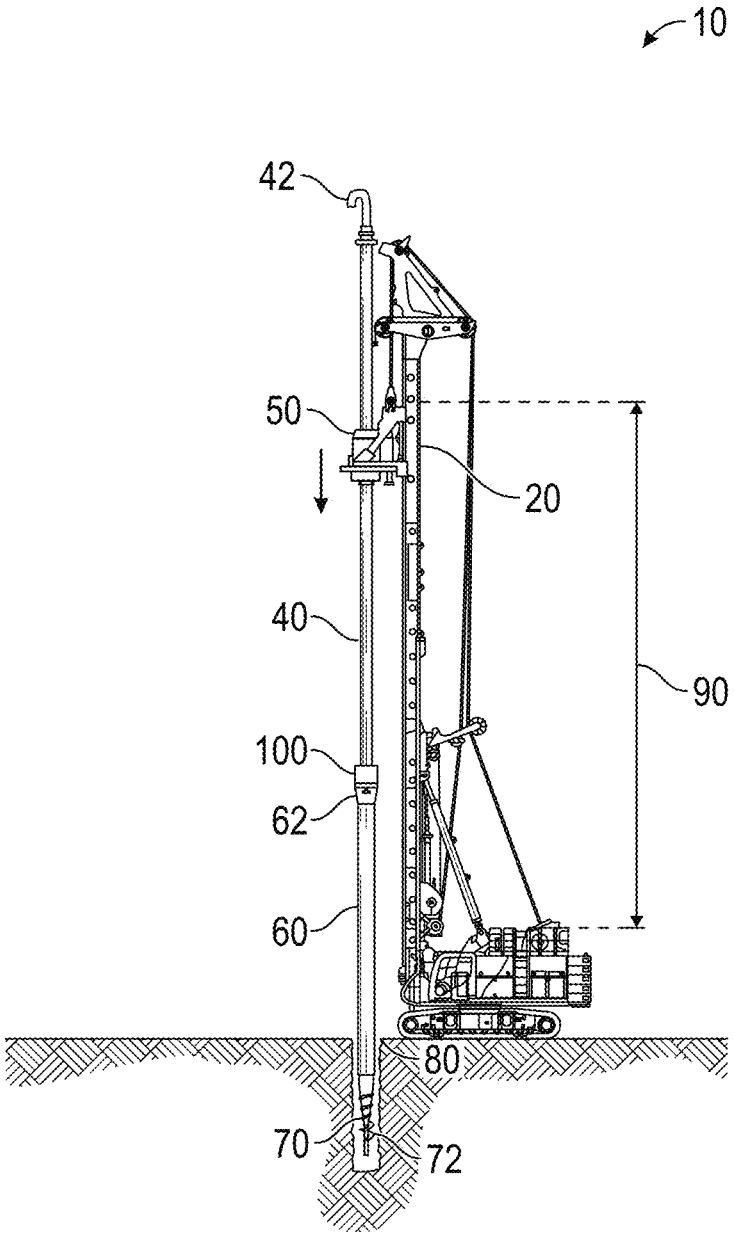
FIG. 1 is a side view of a drilling rig employing embodiments of a casing driver.

Embodiments described within disclose an apparatus and method using an embodiment of a casing driver connected to different points on the drill stem. Thus, embodiments facilitate using a variety of casing lengths for a given drill stem length. Furthermore, in embodiments, the rotary drive may be connected only to the drill stem, with both drill stem and casing being driven by that single connection to the rotary. These embodiments will make it possible to construct drilled foundation piles, including auger cast piles and auger cast displacement piles, in soil conditions that require the use of casing in an upper section of the drilled hole, but where casing is not required in the lower section of the drilled hole. Specifically, the embodiments will enable a drill operator to assemble a drill stem of sufficient length to drill a collection of holes with varying depths and soil conditions and interchange different casing lengths according to the drill depths and soil conditions at each respective hole in the collection. The interchange and use of varying lengths of casing for different holes will not require dissembling the drill stem.

FIG. 1 through FIG. 6 are side views of a drilling rig 10 employing embodiments of a casing driver 100, e.g., a casing driver as described with regard to casing driver 101 (FIG. 8-FIG. 12) and casing driver 102 (FIG. 14-FIG. 21). FIG. 1 through FIG. 6 illustrate methods of using embodiments of casing driver 100. In the embodiment shown in FIG. 1 through FIG. 6, rotary drive 50 has a center through hole that allows the drill stem 40 to pass through the rotary drive 50. Rotary drive 50 may engage the drill stem 40 at different points along drill stem 40. Drill stem 40 passes through a casing 60 and terminates with a drilling tool 70, e.g., a displacement tool with an auger 72. Rotary drive 50 may engage the drill stem 40 at designated locations along drill stem 40 and be used to cause drill stem 40 to rotate about its central axis, causing a drilling tool 70 to rotate as well and create a bore 80. Once bore 80 is completed, and as drilling tool 70 is being removed, a grout, such as concrete, may be supplied to grout conduit 42, and through drill stem 40 into bore 80. A stroke 90 indicates a distance that rotary drive 50 may be lowered and raised and thus represents a bore depth that may be attained when rotary drive 50 travels a single stroke 90. To create a bore with a depth greater than stroke 90, rotary drive 50 may be used to drive drilling tool 70 a first stroke length into the ground. Then, rotary drive 50 may be moved higher up on drill stem 40 and used to force drilling tool 70 further into the soil. Thus, bore 80 may be drilled to a desired depth. In addition, multiple drill stems 40 may be joined together to increase the depth of bore 80 past that of a single drill stem length.

In embodiments, casing driver 100 may be connected to drill stem 40, so that as rotary drive 50 forces drill stem 40 downward or upward or rotates, the downward, upward, or rotational force is transmitted from drill stem 40, through casing driver 100 and into a cone 62 and casing 60. Thus, as drill stem 40 is forced downward or upward or rotated, casing 60 travels or rotates with it. Casing 60 may be disengaged from drill stem 40 at an appropriate depth by disengaging casing driver 100 from drill stem 40. In embodiments, casing driver 100 abuts cone 62 and transfers axial and torsional forces from drill stem 40 to casing 60.

Figure 2:
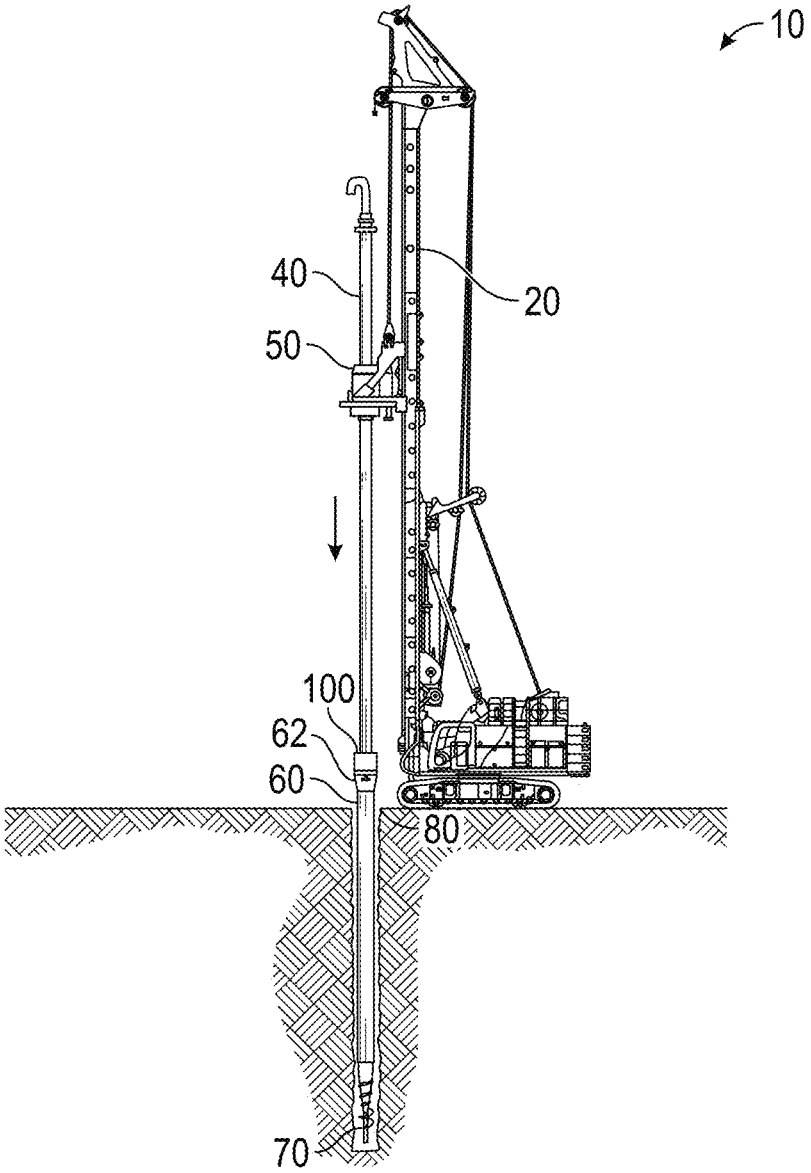
FIG. 2 is a side view of a drilling rig employing embodiments of a casing driver.

In FIG. 1, rig 10 has just begun drilling bore 80. Casing 60 has been assembled around the drill stem 40 and casing driver 100 is engaged to drill stem 40 at a connection point on drill stem 40, which is configured to engage casing driver 100. Casing driver 100 is configured to engage and transmit torsional, upward, and downward forces into cone 62 and into casing 60. Accordingly, with casing driver 100 engaged, casing 60 and drill stem 40 are ready to travel upwards and downwards or rotate together in unison. FIG. 2 illustrates that, as rig 10 drives rotary 50 downward with casing driver 100 engaged to drill stem 40, drill stem 40, casing driver 100, casing 60, and drilling tool 70 travel downward and rotate in unison. Further, FIG. 2 shows that casing 60 has reached a desired casing depth. and, at this point casing driver 100 can be removed so that the remainder of the bore 80 can be drilled without casing 60. In other words, after removing casing driver 100, drill stem 40 may travel independently of casing 60 such that drilling can continue without advancing the casing 60 further into bore 80.

Figure 3:
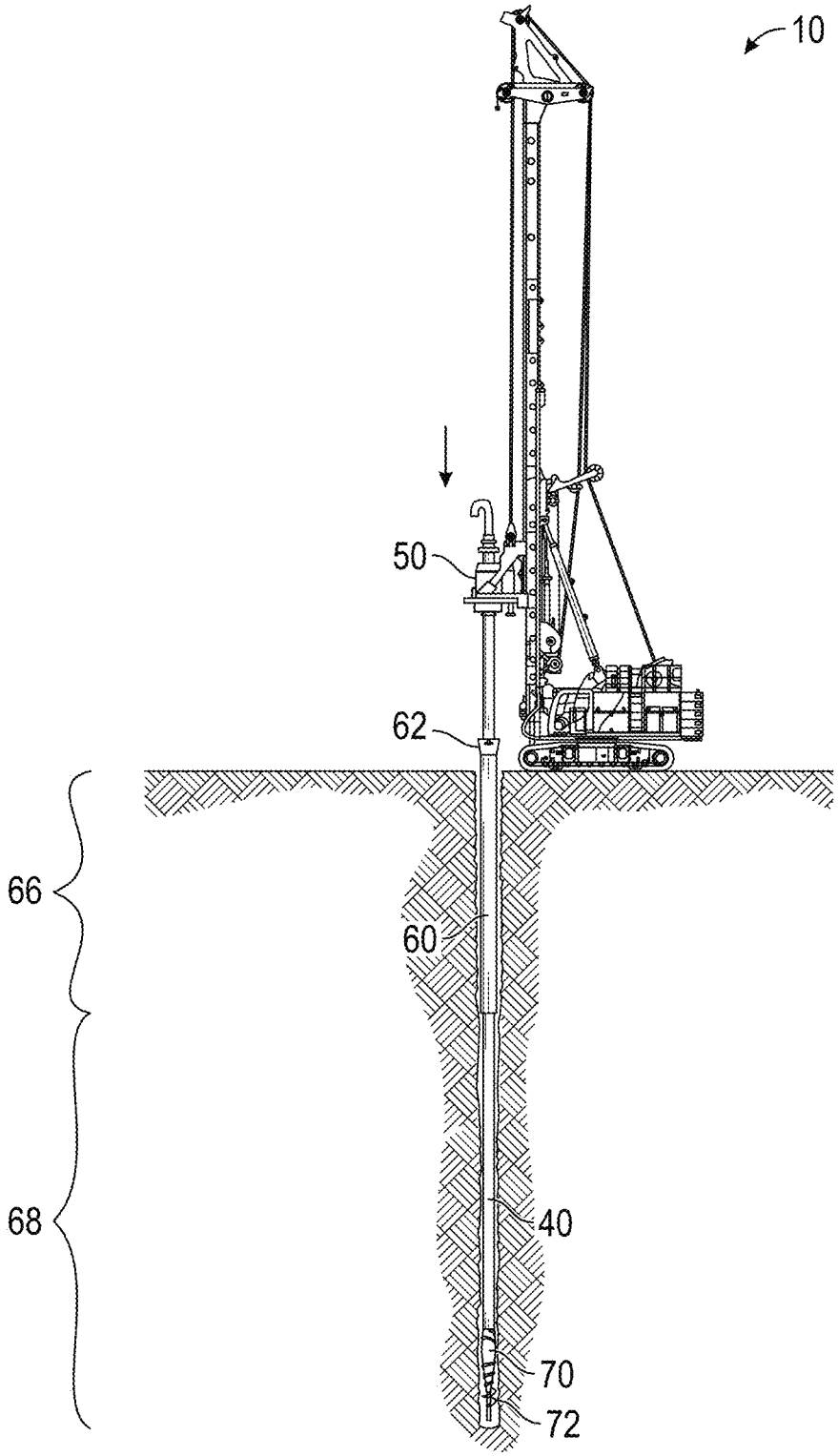
FIG. 3 is a side view of a drilling rig employing embodiments of a casing driver.

FIG. 3 shows that the drill stem and drilling tool 70 have advanced downward to complete bore 80, which would occur after casing driver 100 has been removed or disconnected. Once reaching the bore 80 bottom tip elevation, the completed excavation includes upper cased section 66 and lower uncased section 68. In FIG. 3, casing driver 100 has been removed from drill stem 40 and casing 60. Rotary drive 50 has been relocated to the upper end of drill stem 40. Subsequently, drilling rig 10 has used rotary drive 50 to advance drill stem 40 through casing 60 such that drilling tool 70 has drilled bore 80 a significant depth below casing 60 and has reached the desired depth for bore 80. The completed bore 80 now comprises an upper and lower section. The upper section 66 of bore 80 may be referred to as a "cased section" and the drilling operation may be described as cased drilling or drilling with casing. The bottom section 68 of bore 80, which is drilled without casing, may be referred to as an "uncased section" of bore 80 and the drilling operation may be described as uncased drilling or drilling without casing. This illustrates a feature provided by embodiments in which the length of a casing may be different from the length of a drill stem, and the desired depths for the uncased section 68 of bore 80 may exceed the maximum allowable length of drill stem 40 extending above a rotary drive 50 for a given drill rig 10 and this is accomplished without adding sections of drill stem to drill stem 40.

In FIG. 3, casing driver 100 has been completely removed. However, in embodiments, casing driver 100 may simply be disconnected from drill stem 40 (and remain atop cone 62), such that drill stem 40 may move with respect to both casing driver 100 and casing 60 without imparting that movement to casing 60. Once casing driver 100 has been removed, the drill stem 40 and drilling tool 70 may advance independently of casing 60.

Figure 4:
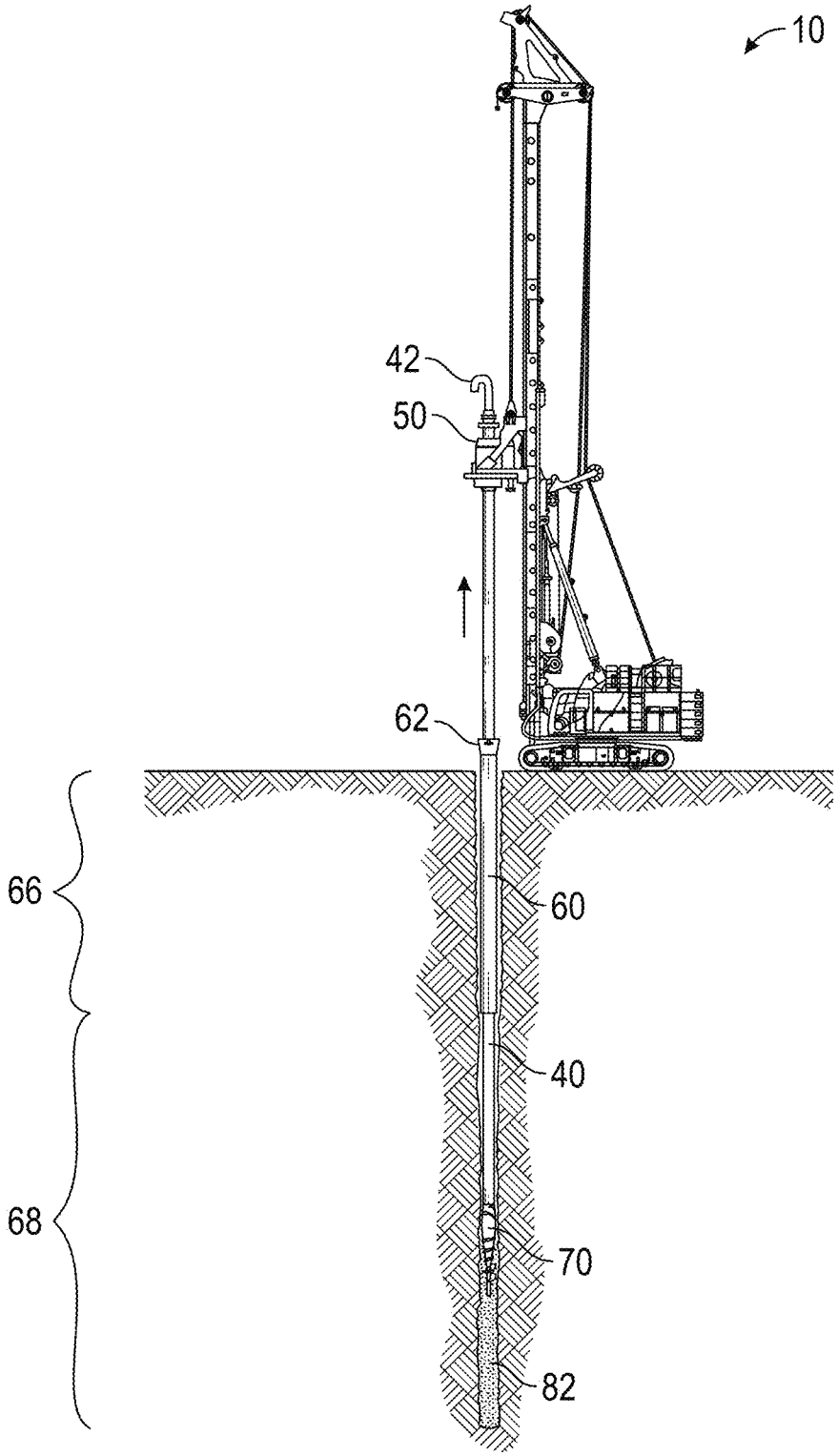
FIG. 4 is a side view of a drilling rig employing embodiments of a casing driver.

In FIG. 4, drilling rig 10 is withdrawing drill stem 40 and drilling tool 70 from bore 80. As drilling tool 70 is being withdrawn, grout 82 is pumped through drilling rig 10 and into bore 80. Grout 82 is pumped through grout conduit 42 (external tubing associated with supplying grout to tubing 42 is not shown for simplicity). The grout travels through a hollow center pipe in drill stem 40 and drilling tool 70 and into bore 80. Drill stem 40 and drilling tool 70 continue traveling upward while pumping grout 82 into bore 80 until a desired connection point on drill stem 40 is just above cone 62, at which point casing driver 100 is re-engaged around drill stem 40 at the connection point on drill stem 40 such that casing 60 and drill stem 40 are ready to travel upwards together in unison. Pumping grout may pause briefly to give support personnel time to re-engage the casing driver 100 and pumping resumes just before casing 60 and drill stem 40 begin advancing upwards together.

In some embodiments, drill stem 40 will be provided with a plurality of connection points configured to engage casing driver 100 and spaced longitudinally along the long axis of drill stem 40. There may also be provided many different sections of casing 60 each having cone 62 fixed to one end and each individual section of casing 60 having a different length measured along its long axis. In these embodiments, when soil conditions or structural designs require varying lengths of upper cased sections between holes, a drill operator may interchange the different sections of casing 60 to match the casing length requirements of each individual hole to the length of each individual section of casing 60.

Figure 5:
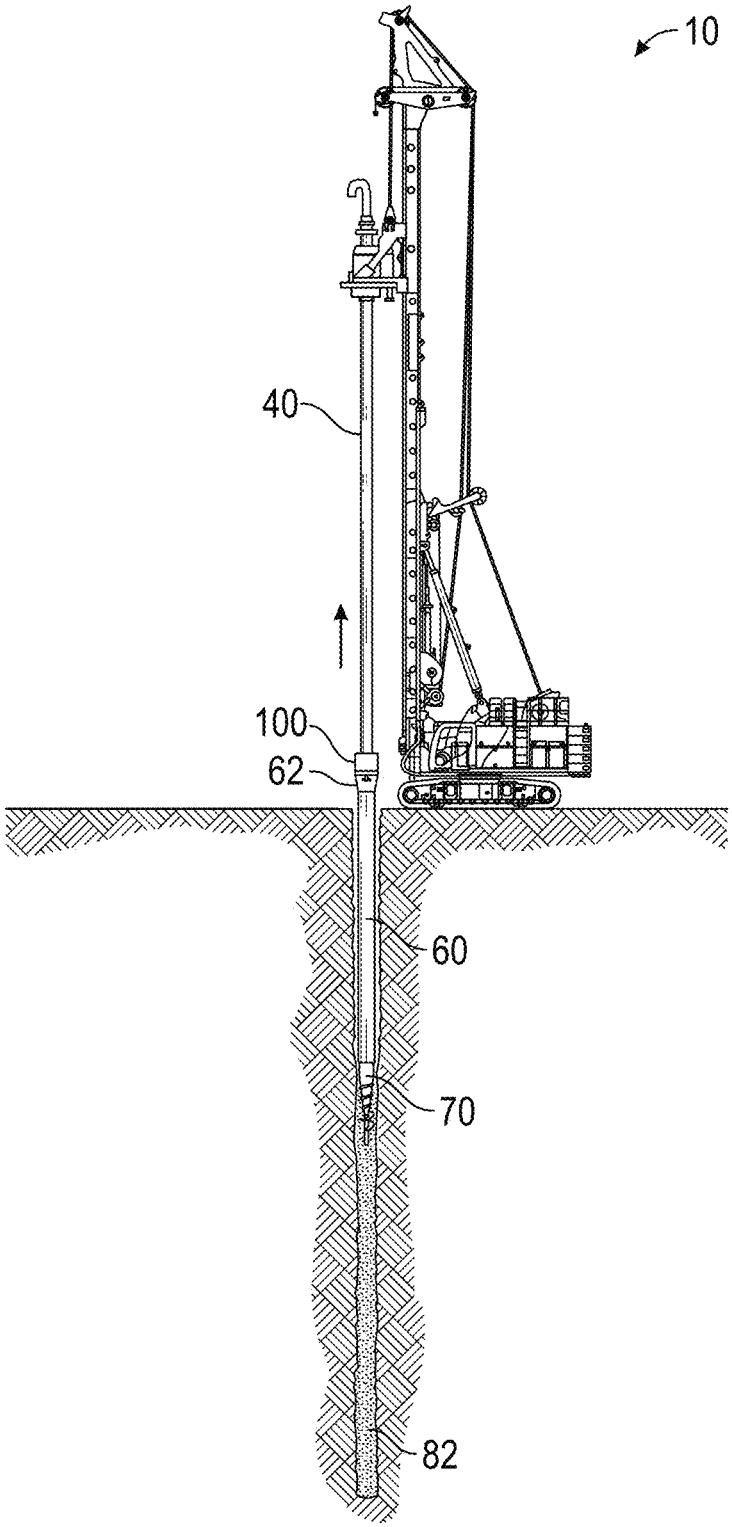
FIG. 5 is a side view of a drilling rig employing embodiments of a casing driver.

In FIG. 5, drill string 40 has been withdrawn fully back into casing 60 such that drilling tool 70 is positioned at a lower distal end of casing 60 and a desired connection point on drill stem 40 is positioned just above cone 62 to allow casing driver 100 to be re-installed. In FIG. 5, casing driver 100 has been re-installed back on drill string 40 and engages cone 62, allowing the further upward travel of drill string 40 to withdraw both drill stem 40 and casing 60 as one, with grout 82 being supplied to fill bore 80 as drill stem 40 and casing 60 are raised.

Figure 6:
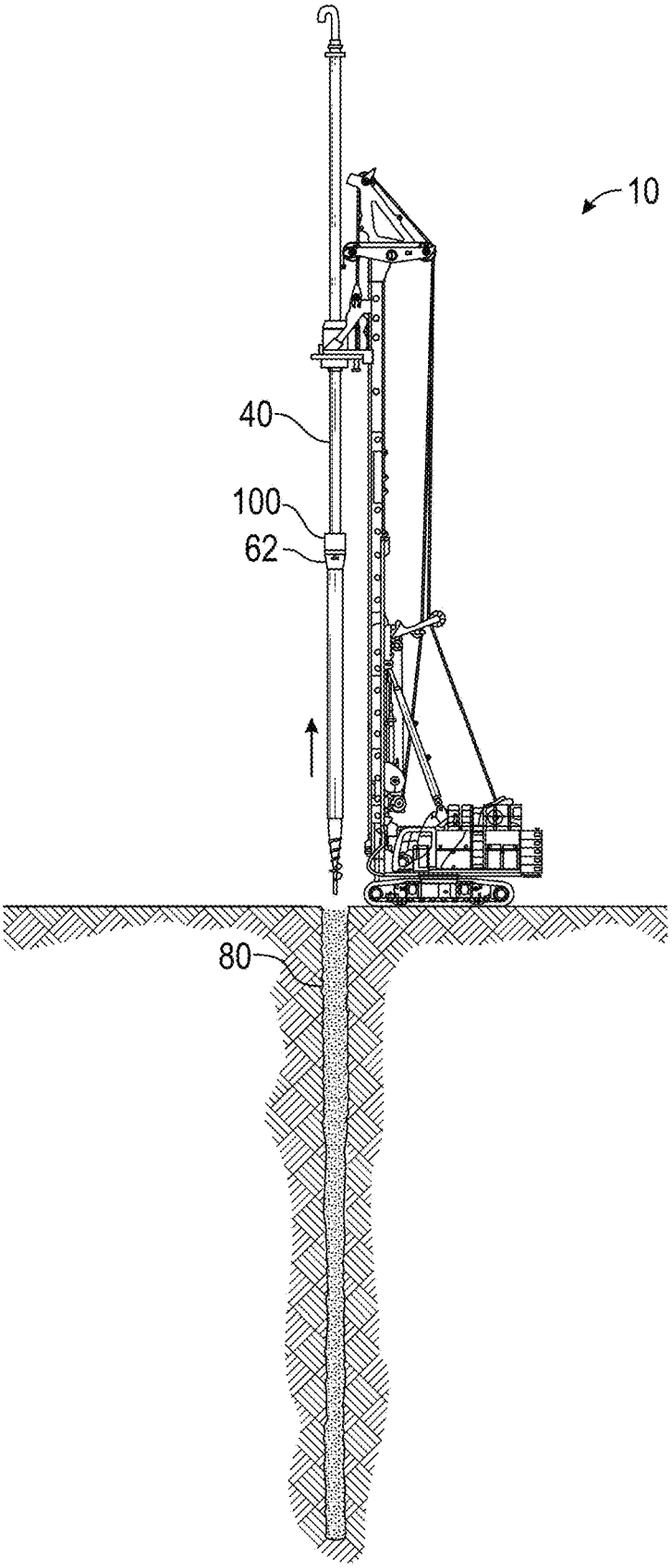
FIG. 6 is a side view of a drilling rig employing embodiments of a casing driver.

In FIG. 6, drill stem 40 and casing 60 have been completely removed from bore 80, which is shown completely filled with grout. Bore 80 is complete and grouted when casing 60, drill stem 40, and drilling tool 70 are removed from bore 80.

Figure 7:
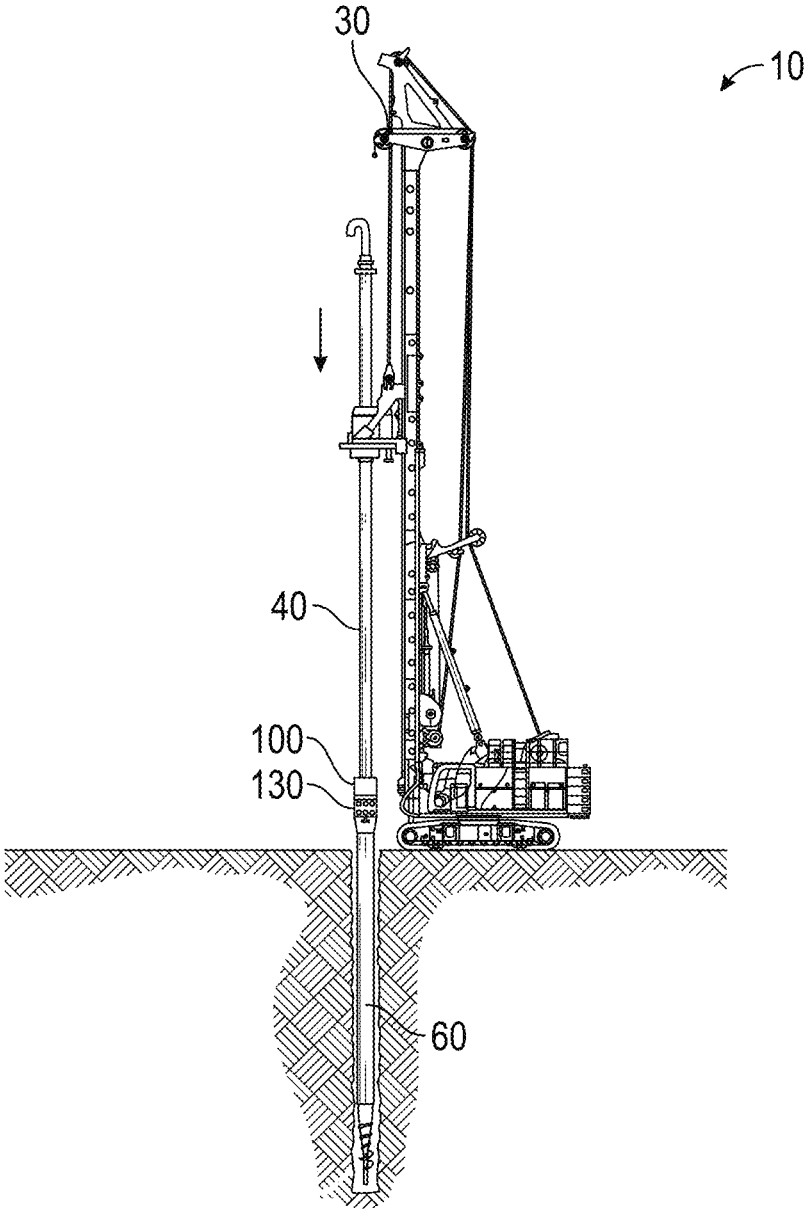
FIG. 7 is a side view of a drilling rig employing embodiments of a casing driver.
Figure 12:
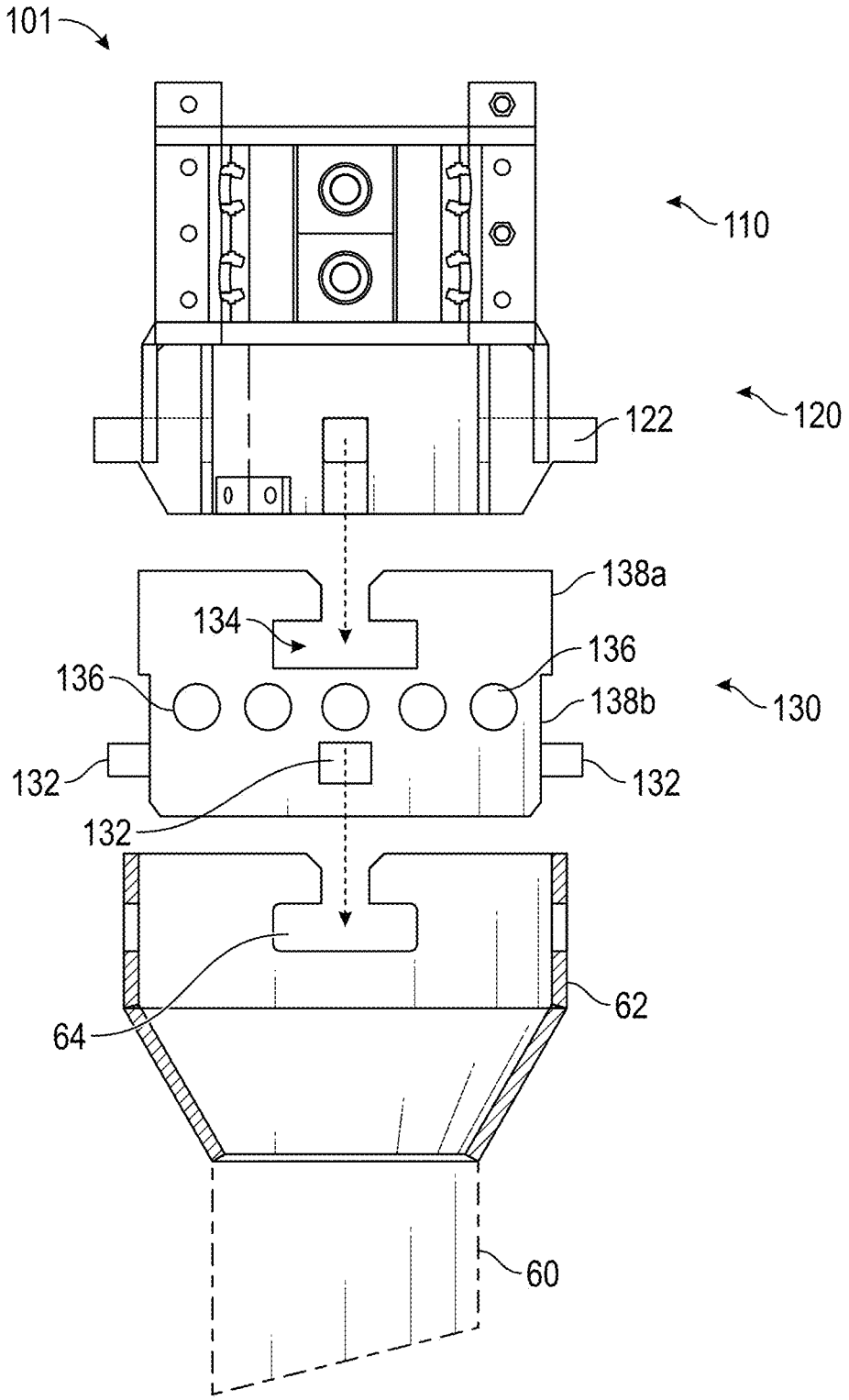
FIG. 12 is a side view of the first embodiment of a casing driver.
Figure 21:
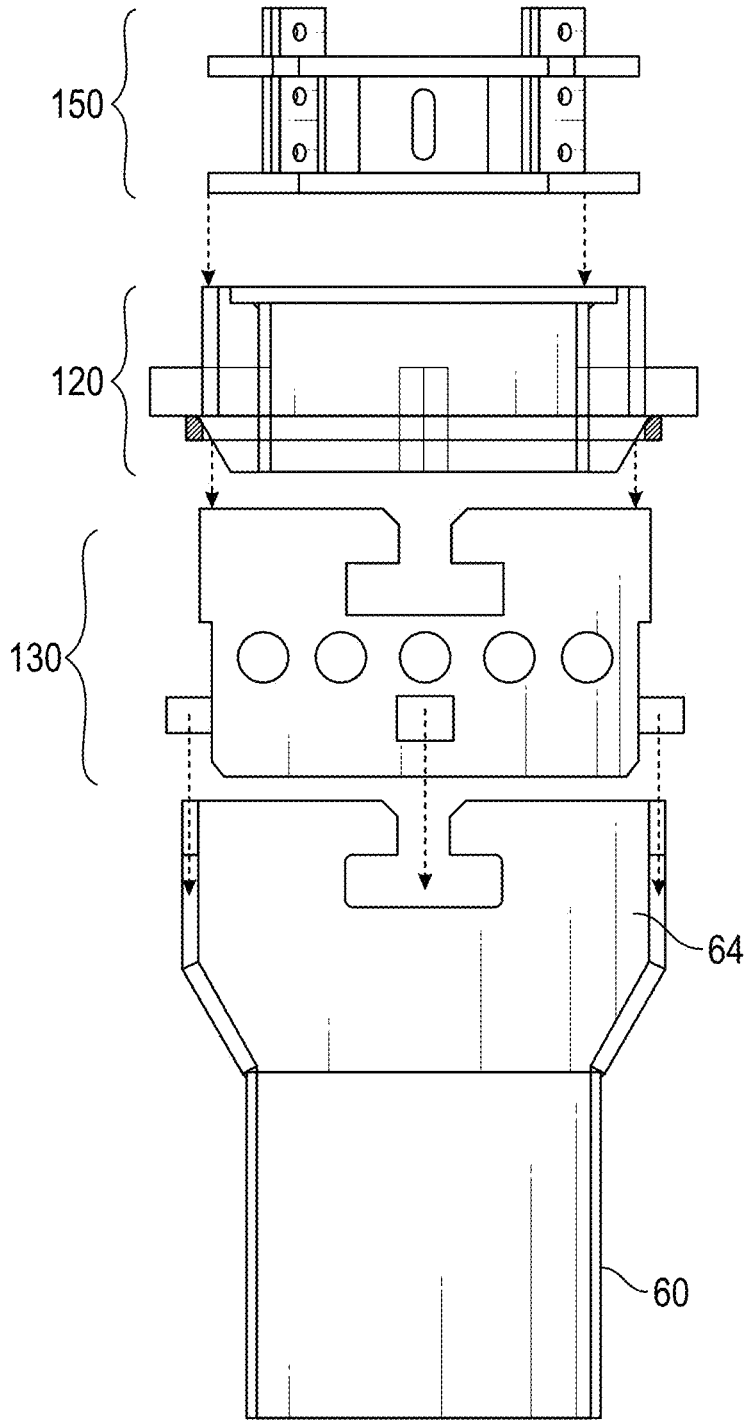
FIG. 21 is a side view of the second embodiment of a casing driver.

FIG. 7 is a side view of drilling rig 10 employing embodiments of a casing driver 100 that include a perforated spacer 130. Perforated spacer 130 may be positioned between casing driver 100 and casing 60 (as shown in FIG. 7, FIG. 12, and FIG. 21) and the arrangement used as described with respect to FIG. 1 and FIG. 6. Perforated spacer 130 allows the spoils of the drilling process to pass from within casing 60 and exit through the perforations. Thus, embodiments of casing driver 100 with perforated spacer 130 may be used where spoils travel between the drill stem and casing.

Thus, a method of using an embodiment of a casing driver connected to the drill string may include: a step of connecting a rotary drive of a drilling rig to a drill stem at a first longitudinal location on the drill stem, the drill stem including a drill bit at a distal end; a step of connecting a drive head to the drill stem at a second longitudinal location on the drill stem separated from the first longitudinal location; a step of placing a casing about the drill stem with a drive head, the casing extending from the drive head connected to the drill stem toward the drill bit; and a step of drilling a first length of a bore with the drill stem and casing moving into the bore and without relative axial motion between the casing and pipe. The method may further comprise, after drilling the first length of the bore: a step of disconnecting the drive head from the drill stem; and a step of drilling a second length of the bore with the drill stem moving axially within the casing and the casing remaining within the first length of the bore. The method may further comprise a step of pumping grout into the bore; while pumping grout, a step of lifting the drill stem out of the second length of the bore with the drill stem moving axially within the casing at a rate that matches the rate grout is filling the bore; a step of reconnecting the drive head to the drill stem; and while pumping grout into the bore, a step of lifting the drill stem, casing out of the first length of the bore and without relative axial motion between the casing and drill stem.

Figure 8:
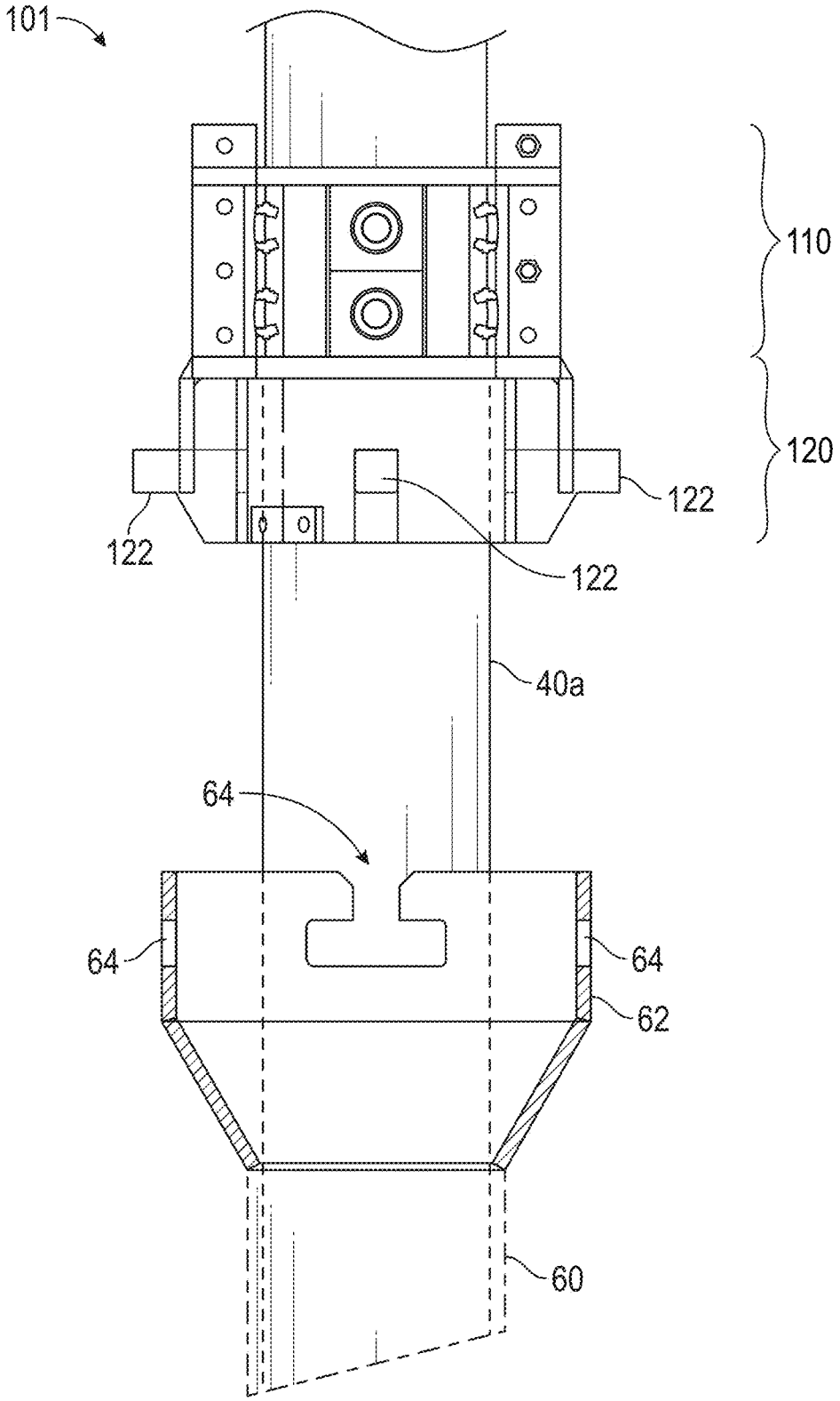
FIG. 8 is a side view of a first embodiment of a casing driver.

FIG. 8 is a side view of a first embodiment 101 of casing driver 100. Casing driver 101 is adapted to connect to a drill stem 40*a* that is round in cross-section (FIG. 8B). In FIG. 8, casing driver 101 includes a drill stem attachment 110 and a casing interface 120. Bar attachment 110 is connected to drill stem 40*a* so that both rotation and axial movement of drill stem 40*a* is imparted to drill stem attachment 110. Drill stem 40*a* is shown to pass into and through casing 60.

Figure 11:
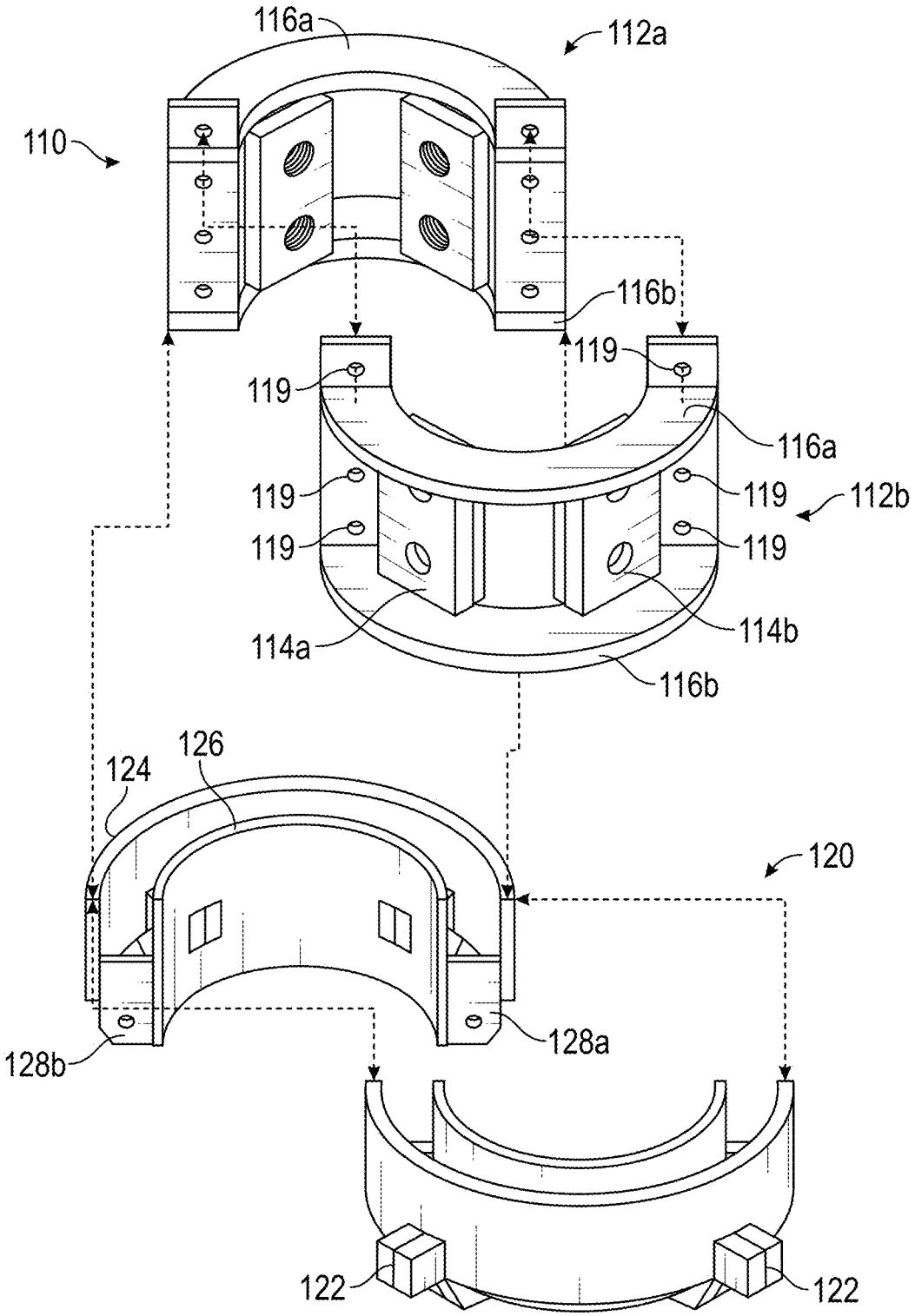
FIG. 11 is an upper isometric view of the first embodiment of a casing driver disassembled.

In the embodiment, drill stem attachment 110 is fixed to casing interface 120. As shown in FIG. 11, drill stem attachment 110 and casing interface 120 each comprise identical interface halves configured to wrap around and bolt to drill stem 40*a* as shown in FIG. 8. Thus, linear and torsional forces are transmitted from stem 40*a* through drill stem attachment 110 to casing 60, causing casing 60 to travel with drill stem 40*a* into the bore.

Casing interface 120 includes posts 122 that extend radially and are configured to be received by slots 64, e.g., T-slots, within cone 62. Thus, in the embodiment, casing interface 120 partially enters cone 62 to the depth that posts 122 descend into slots 64 and linear and torsional forces may be transmitted from casing interface 120 into cone 62 and casing 60. The connection between cone 62 and casing 60 may include welding, machine threading, and/or bolting.

FIG. 9A is a side view of aspects of drill stem 40*a*, configured to be used with casing driver 101. FIG. 9B is a top view of the section indicated in FIG. 9A. In FIG. 9A and FIG. 9B, drill stem 40*a* is shown to be provided with plates 44 that are configured to receive fasteners that connect drill stem attachment 110 to drill stem 40*a*. FIG. 9A illustrates a single section of drill stem 40*a* with an upper connection and a lower connection. Multiple such sections may be combined, one atop the other, depending on the desired depth of bore 80. In addition, while FIG. 9A illustrates two sets of plates 44 about drill stem 40*a*, in embodiments, sets of plates 44 may be distributed along drill stem 40*a* at arbitrary locations according to the desires of the operator. Providing two or more plates 44 spaced along the long axis of a drill stem 40*a* enables the use of varying lengths of casing 60 without a drill operator needing to reconfigure the assembled drill stem.

Figure 10B:
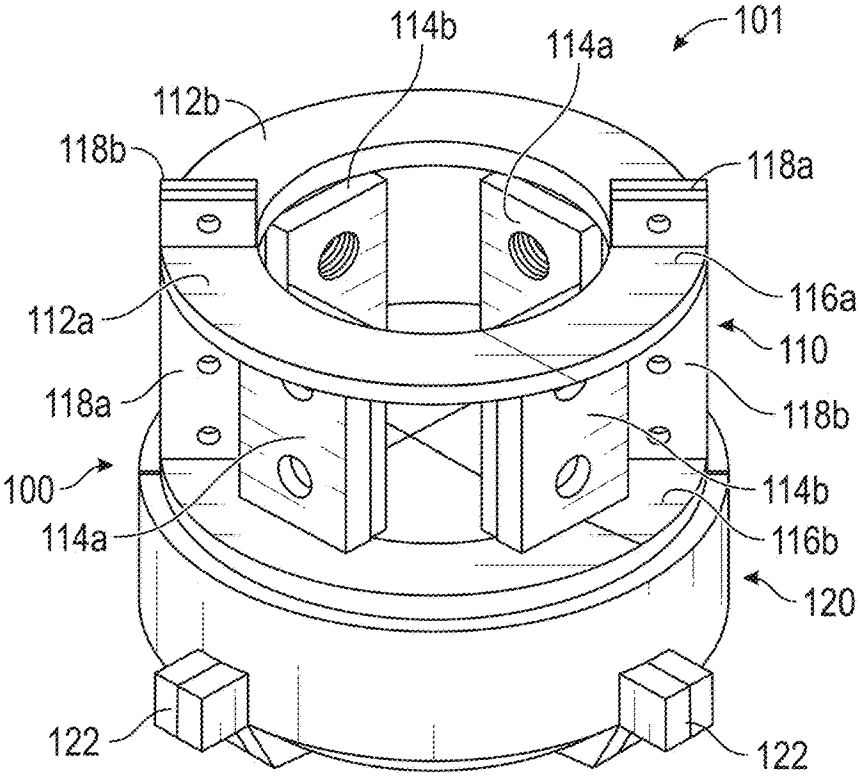
FIG. 10B is an upper isometric view of the first embodiment of a casing driver.
Figure 10A:
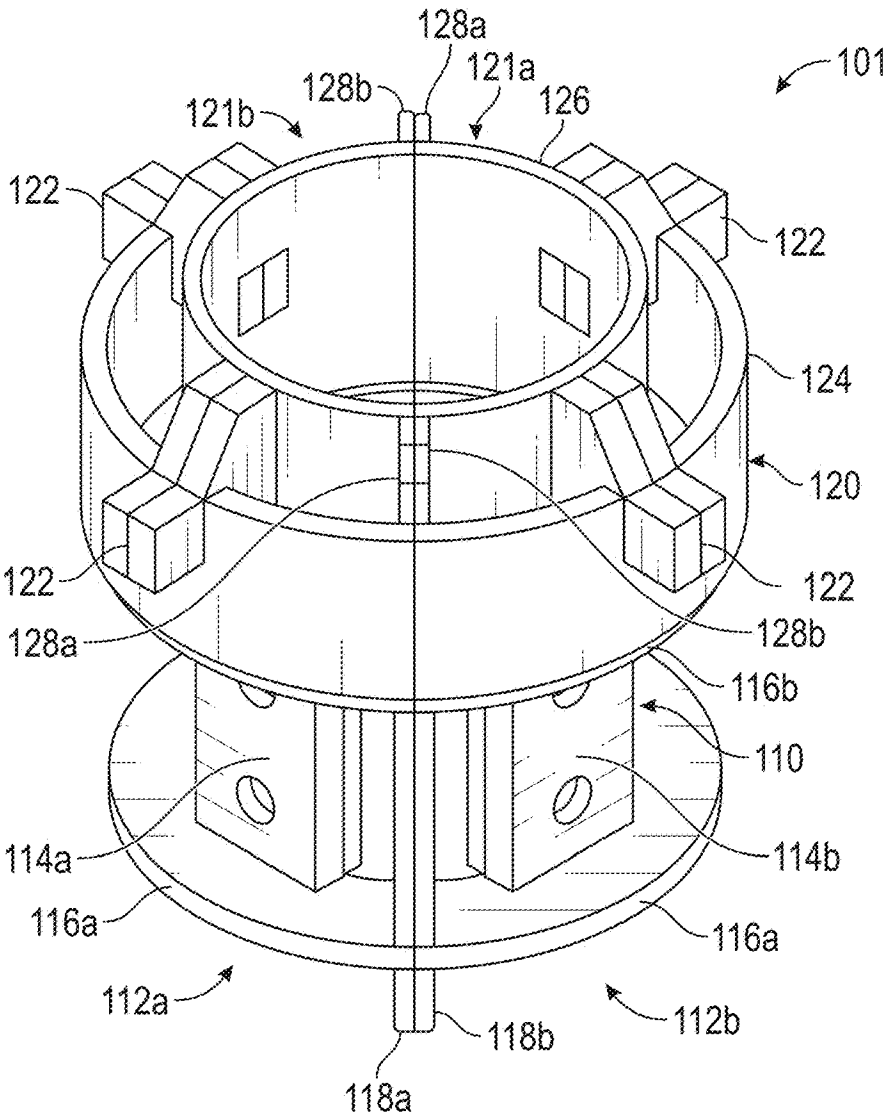
FIG. 10A is a bottom isometric view of the first embodiment of a casing driver when inverted.

FIG. 10A is an isometric view of casing driver 101 when inverted. FIG. 10B is an upper isometric view of casing driver 101. In FIG. 10A, casing interface 120 is shown to include identical interface halves 121*a* and 121*b*. Each half 121*a*, 121*b* includes an outer ring segment 124 and an inner ring segment 126. Inner ring segment 126 is connected to outer ring segment 124 by posts 122, which are inserted into a window of inner ring segment 126 and received by a slot in outer ring segment 124. Halves 121*a*, 121*b* are joined together using fasteners through flanges 128*a*, 128*b*.

Drill stem attachment 110 includes identical attachment halves 112*a*, 112*b*. Each half 112*a*, 112*b* includes an upper flange 116*a* and a lower flange 116*b* connected by connector plates 114*a*, 114*b* and by connector flanges 118*a*, 118*b*. Halves 112*a*, 112*b* are joined together, e.g., using fasteners through holes 119, in flanges 118*a*, 118*b*. The identical attachment halves 112*a*, 112*b* of drill stem attachment 110 are each welded to the respective identical interface halves 121*a* and 121*b* of casing interface 120.

In FIG. 10A, posts 122 are shown to taper from inner ring section 126 to outer ring section 124. This taper helps center casing interface 120 and drill stem 40*a* within cone 62 when casing driver 101 is being lowered toward casing 60.

FIG. 11 is an upper isometric view of casing driver 101 partially disassembled with halves 112*a*, 112*b* separated. In this configuration, halves 112*a*, 112*b* may be placed about drill stem 40*a* and fasteners passed through connector plates 114*a*, 114*b* and received into plates 44. The connection to drill stem 40*a* may be further strengthened and made rigid by clamping halves 112*a*, 112*b* together with fasteners through flanges 118*a*, 118*b*. Similarly, casing interface 120 is shown with halves 121*a*, 121*b* separated. In this configuration, halves 121*a*, 121*b* may be placed about drill stem 40*a* (between drill stem attachment 110 and cone 62 of casing 60) and fastened together using fasteners through flanges 128*a*, 128*b*.

Thus, in an embodiment, drill stem attachment half 112*a* is rigidly fixed to casing interface half 121*a* and drill stem attachment half 112*b* is rigidly fixed to casing interface half 121*b*. For example, flange 116*a* may be welded to inner ring section 126 and outer ring section 124. Thus, when the two such joined sections 112*a*, 121*a* and 112*b*, 121*b* are placed about drill stem 40*a*, fastened to drill stem 40*a*, and fasted together using flanges 118*a*, 118*b*, 128*a*, 128*b*, rotation of drill stem 40*a* will be imparted to both drill stem attachment 110 and casing interface 120. Thus, when posts 122 are within cone slots 64, rotation of drill stem 40*a* will force casing 60 to rotate.

FIG. 12 is a side view of casing driver 101 including perforated spacer 130. In FIG. 12, perforated spacer 130 includes posts 132, slots 134, and perforations 136. Slots 134 are shown to be configured similarly to cone slots 64, which allows spacer 130 to be used without modifying casing interface 120. Similarly, posts 132 are shown to be configured similarly to posts 122, which allows spacer 130 to be used without modifying cone 62. In the embodiment, perforated space 130 includes an upper section 138*a* with a diameter configured to receive casing interface 120 and a lower section 138*b* with a diameter configured to be received by cone 62. In embodiments, the length of sections 138*a*, 138*b* and the number and size of perforations 136 may be changed arbitrarily as desired by the operator to accommodate spoils of different volume flow rates, dimensions, and consistencies. For drilling applications that require exhausting rather than displacing drill cuttings, incorporating the perforated spacer 130 allows a drill operator to exhaust drill cuttings while drilling.

Figure 13A:
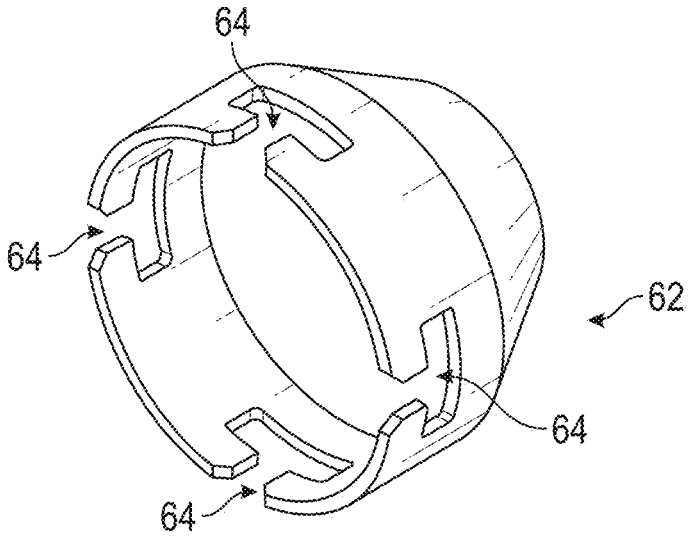
FIG. 13A is an upper isometric view of aspects of embodiments of a casing driver.
Figure 13B:
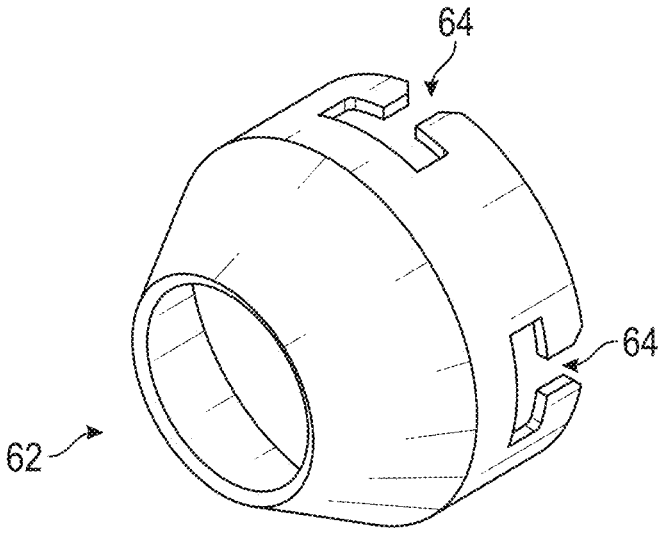
FIG. 13B is a lower isometric view of aspects of embodiments of a casing driver.

FIG. 13A is an isometric view of the upper section of cone 62. FIG. 13B is an isometric view of the lower section of cone 62. Although not shown for clarity, cone 62 is fixed to casing 60. The means for fixing cone 62 to casing 60 may include welding, machine threading, and bolting. In embodiments, a casing driver 100, e.g., as described above with reference to casing driver 101 (FIG. 8-FIG. 12) or below with reference to casing driver 102 (FIG. 14-FIG. 21), may interface with cone 62 of casing 60 by engaging slots 64 with, e.g., posts 122 of casing interface 120 or posts 132 of perforated spacer 130. As shown, slots 64 allow posts 122, 132 to enter through a top section and descend to a wider lower section. Thus descended, posts 122, 132 may rotate slightly within slots 64 without imparting that rotation to cone 62. When slightly rotated, posts 122, 132 may engage a side lobe of slot 64, which prevents withdrawing posts 122, 132 upward from slot 64. Thus, when casing interface 120 is connected to drill stem attachment 110, drill stem 40*a* may be used to pull cone 62 and casing 60 upward and, e.g., out of bore 80.

Figure 14:
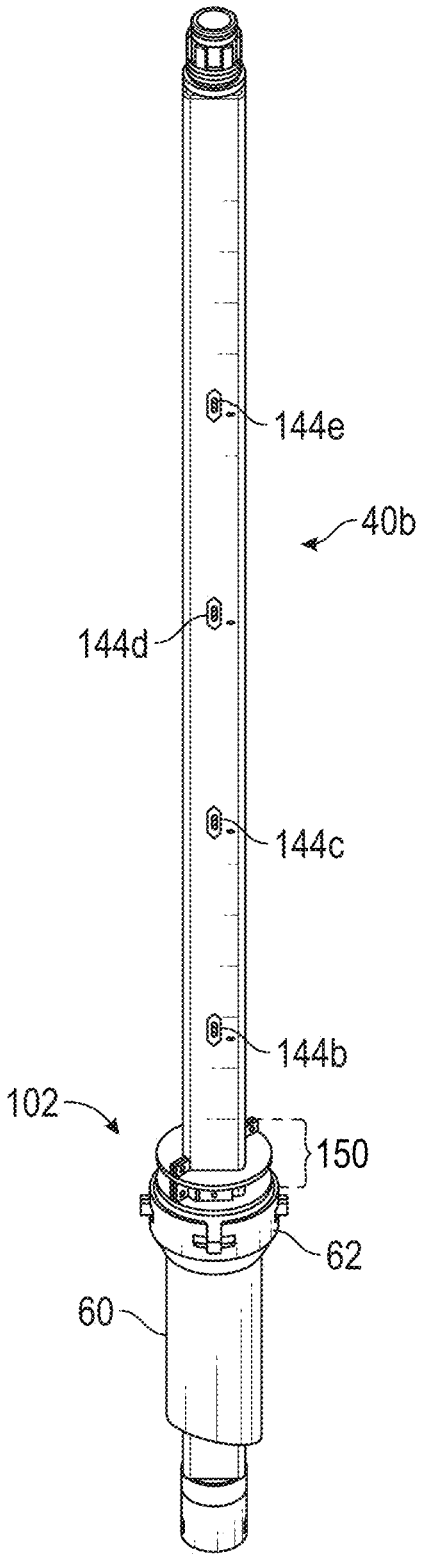
FIG. 14 is an upper isometric view of a second embodiment of a casing driver.

FIG. 14 is an upper isometric view of a second embodiment 102 of casing driver 100. In FIG. 14, casing driver 102 is adapted to a different drill stem 40, i.e., a square drill stem 40*b*.

Figure 15C:
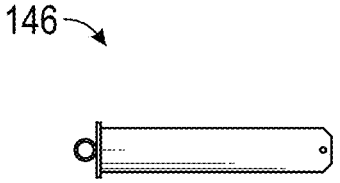
FIG. 15C is a side view of aspects of the second embodiment of a casing driver.
Figure 16:
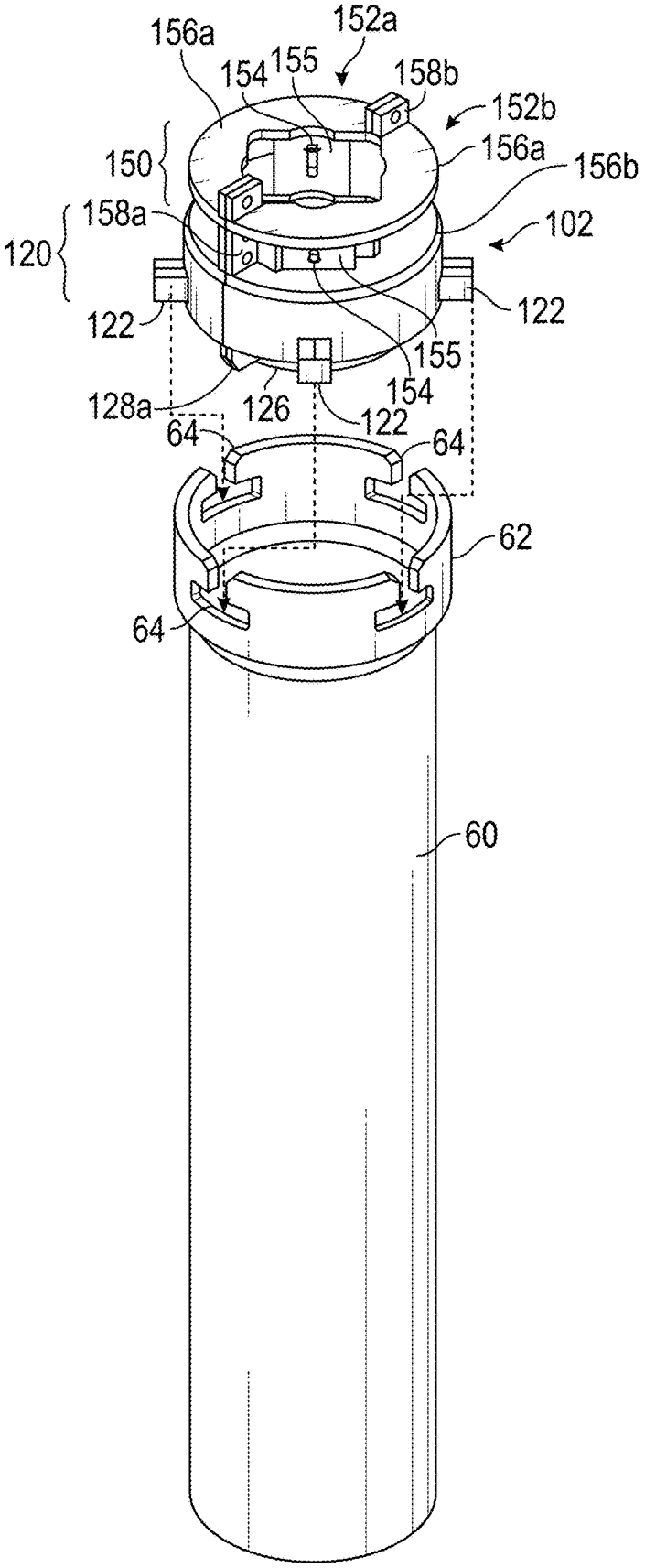
FIG. 16 is an upper isometric view of aspects of the second embodiment of a casing driver.

In FIG. 14, casing driver 102 includes a drill stem attachment 150 and a casing interface 120. Drill stem attachment 150 is connected to drill stem 40*b* using a pin 146 (FIG. 15C) that passes through drill stem attachment 150 and into one of slots 144*a* . . . 144*e* of drill stem 40*b*. Thus, drill stem attachment 150 is connected to drill stem 40*b* so that both rotation and axial movement of drill stem 40*b* is imparted to drill stem attachment 150 (FIG. 16). As with casing driver 101, drill stem 40*b* passes through casing driver 102 and into cone 62 and casing 60.

In the embodiment, drill stem attachment 150 is fixed to casing interface 120, for example, by welding. Thus, linear force is transmitted from stem 40*b* through drill stem attachment 150 to casing 60, causing casing 60 to travel with drill stem 40*b* into the bore. Likewise, rotation of drill stem 40*b* is transmitted from drill stem attachment 150 to casing interface 120 and into casing 60.

In other embodiments, drill stem attachment 150 abuts casing interface 120 but is not otherwise connected to casing interface 120. Thus, linear force is transmitted from stem 40*b* through drill stem attachment 150 to casing 60, causing casing 60 to travel with drill stem 40*b* into the bore. However, in the embodiment, rotation of drill stem 40*b* is not transmitted from drill stem attachment 150 to casing interface 120 because drill stem attachment 150 spins atop casing interface 120.

As with casing driver 101, with casing driver 102, casing interface 120 includes posts 122 that extend radially and are received by slots 64, e.g., T-slots, within cone 62. Thus, in the embodiment, casing interface 120 partially enters cone 62 to the depth that posts 122 descend into slots 64.

Figure 15A:
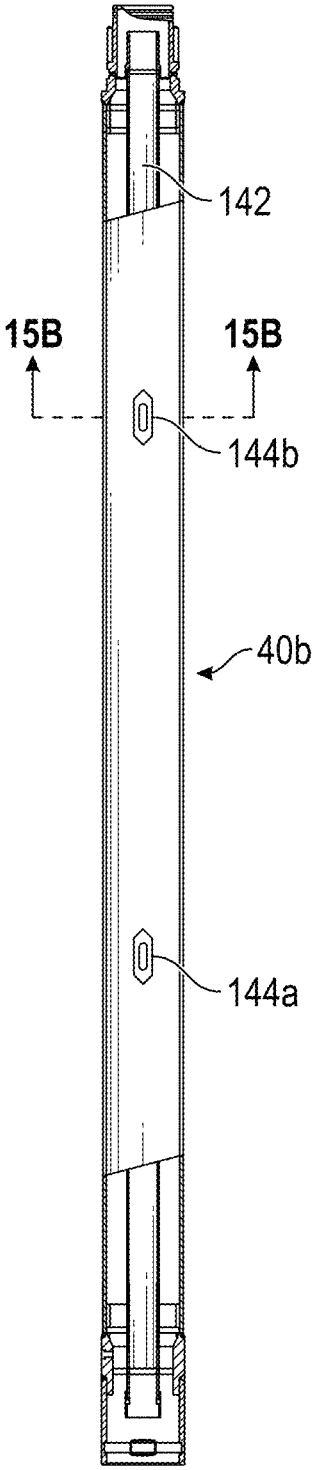
FIG. 15A is a side view of aspects of the second embodiment of a casing driver.
Figure 15B:
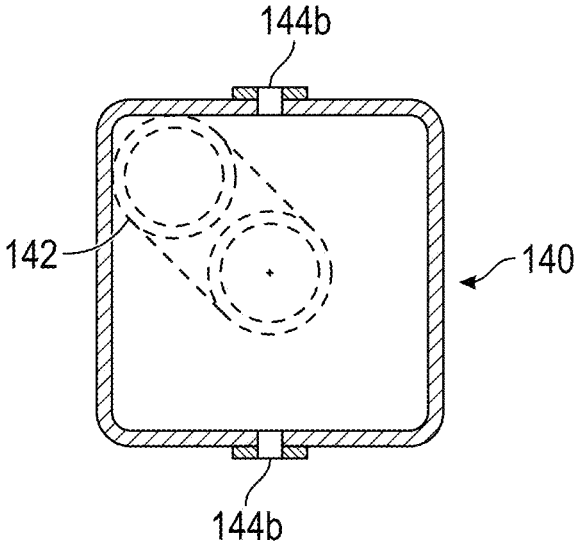
FIG. 15B is a top view of the section of the embodiment of a casing driver indicated in FIG. 15A.

FIG. 15A is a side view of drill stem 40*b*. FIG. 15B is a top view of the section indicated in FIG. 15A. In FIG. 15A and FIG. 15B, drill stem 40*b* is shown to be provided with slots 144*a* . . . 144*b* that are configured to receive pin 146 (FIG. 15C). FIG. 15A illustrates a single section of drill stem 40*b* with a male upper connecting section and a female lower connecting section. Multiple such sections may be combined, one atop the other, depending on the desired depth of bore 80. In addition, while FIG. 15A illustrates two sets of slots 144*a*, 144*b* through drill stem 40*b*, in embodiments, an arbitrary number of slots 144 may be provided in drill stem 40*b* at arbitrary locations according to the desires of the operator. Providing two or more slots 144 spaced along the long axis of a drill stem 40*b* enables the use of varying lengths of casing 60 without a drill operator needing to reconfigure or disassemble the drill string.

FIG. 15B further illustrates that a grout conduit 142 within drill stem 40*b* is flexible enough to be moved aside within drill stem 40*b* so that pin 146 may pass from one slot, e.g., slot 144*b* through the center of drill stem 40*b* and through the corresponding other slot, e.g., slot 144*b*. The direction grout conduit 142 is flexed may alternate to prevent unbalanced rotation of the drill stem 40*b* during drilling operations.

FIG. 16 is an isometric view of casing driver 102 separated from cone 62. In FIG. 16, drill stem attachment 150 is fixed to casing interface 120. The means for fixing drill stem attachment 150 to casing interface 120 may include welding, a threaded connection or a bolted connection. Drill stem attachment 150 includes identical attachment halves 152*a*, 152*b*. Each half 152*a*, 152*b* includes an upper flange 156*a* and a lower flange 156*b* connected by two connector plates 155 and by connector flanges 158*a*, 158*b*. Halves 152*a*, 152*b* are joined together, e.g., using fasteners through holes 159 in flanges 158*a*, 158*b*. Each connector plate 155 includes a pin slot 154. To fix drill stem attachment 150 at a certain longitudinal location of drill stem 40*b*, pin 146 is passed through a first pin slot 154, through the two pin slots 144 at the desired location on drill stem 40*b*, and through a second pin slot 154 of drill stem attachment 150. Thus, drill stem attachment 150 is fixed longitudinally on drill stem 40*b* and axially about drill stem attachment 150. In addition, upper flange 156*a* and lower flange 156*b* are configured to receive square drill stem 40*b* so that rotation of drill stem 40*b* is transferred to drill stem attachment 150 by the corners of drill stem 40*b* contacting and transferring torque to flanges 156*a*, 156*b*.

Figure 17:
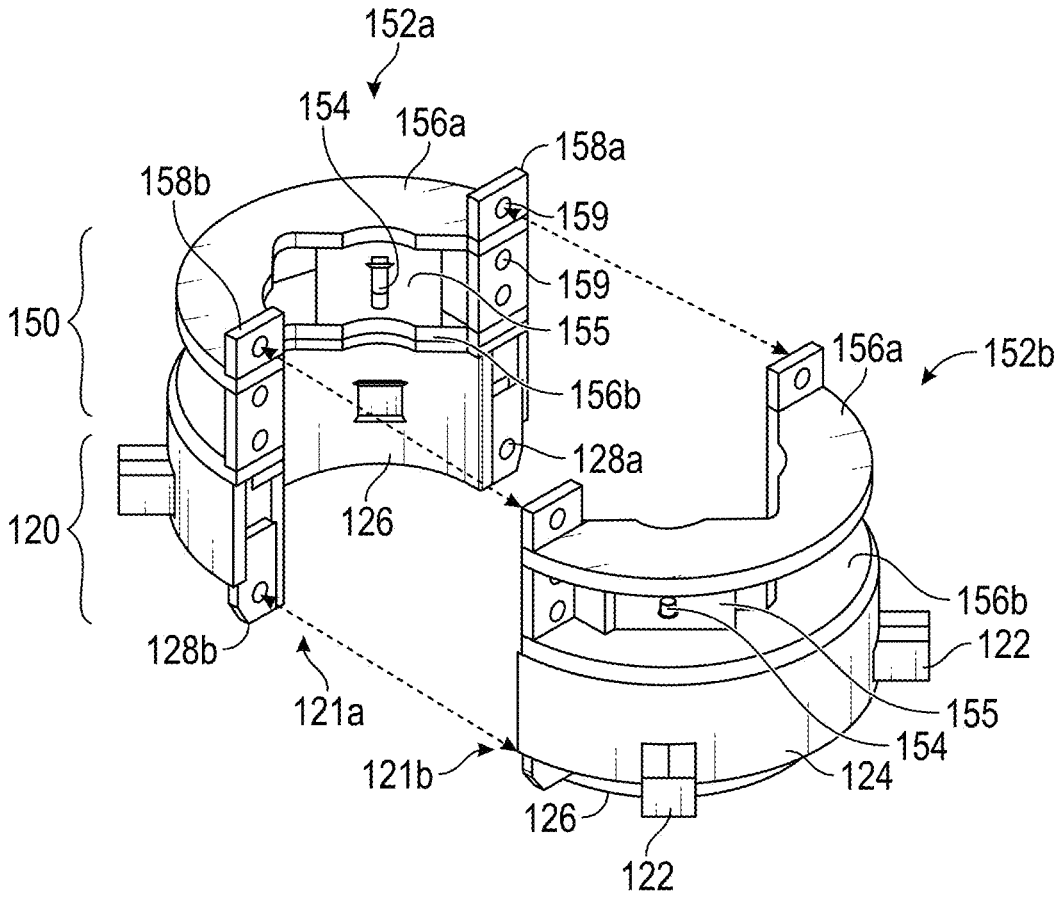
FIG. 17 is an upper isometric view of the second embodiment of a casing driver disassembled.

FIG. 17 is an upper isometric view of casing driver 102 partially disassembled. In FIG. 17, drill stem attachment 150 is shown with halves 152*a*, 152*b* separated. Similarly, casing interface 120 is shown with halves 121*a*, 121*b* separated. Attachment halves 152*a*, 152*b* are shown to be atop and fixed to interface halves 121*a*, 121*b*. The means to connect each respective attachment half 152*a*, 152*b* and to the respective interface half 121*a*, 121*b* may include welding, a threaded connection or a bolted connection. In other embodiments, these halves are not fixed together and rotation of drill stem attachment 150 is not imparted to casing interface 120, since drill stem attachment 150 may spin atop casing interface 120.

In the configuration shown in FIG. 17, halves 152*a*, 152*b* may be placed about drill stem 40*b* and a pin 146 passed through a pair of pin slots 154 of drill stem attachment 150 and a pair of pin slots 144 of drill stem 40*b*. The connection to drill stem 40*b* may be further strengthened and made rigid by clamping halves 152*a*, 152*b* together with fasteners through flanges 158*a*, 158*b*. Similarly, casing interface 120 may be connected about drill stem 40*b* in the manner discussed previously with regard to drill stem 40*a*.

Thus, when drilling a bore, drill stem 40*b* may be used to drive flanges 156*b* of drive drill stem attachment 150 against inner ring sections 126 of casing interface 120. Because, in the embodiment, flanges 156*b* are connected or fixed, e.g., by welding, to inner ring sections 126, drill stem attachment 150 and casing interface 120 rotate together about the drill axis and transfer torsional, upward, and downward force into cone 62 and casing 60.

As a result, drill stem attachment half 152*a* is rigidly fixed to casing interface half 121*a* and drill stem attachment half 152*b* is rigidly fixed to casing interface half 121*b*. For example, flange 156*a* may be welded to inner ring section 126 and outer ring section 124. Thus, when the two such joined sections 152*a*, 121*a* and 152*b*, 121*b* are placed about drill stem 40*b*, pinned to drill stem 40*b*, and fasted together using flanges 158*a*, 158*b*, 128*a*, 128*b*, rotation of drill stem 40*b* will be imparted to both drill stem attachment 150 and casing interface 120. Thus, when posts 122 are within cone slots 64, rotation of drill stem 40*b* will force casing 60 to rotate.

Figure 18:
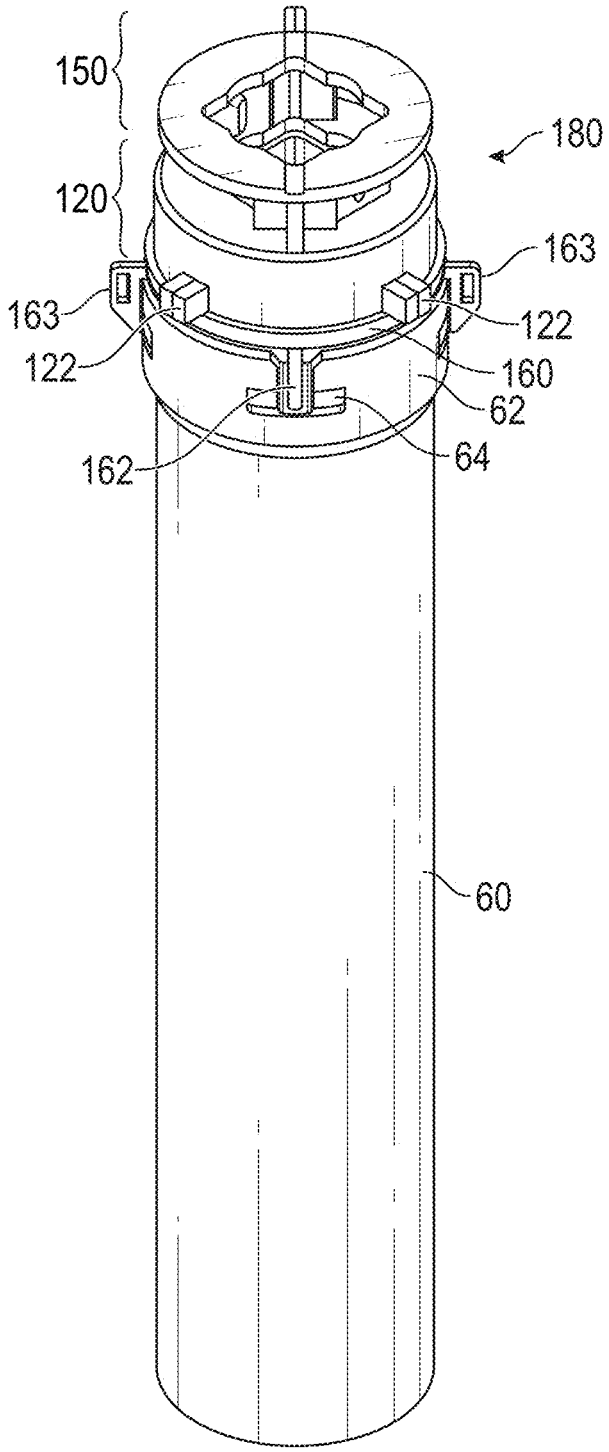
FIG. 18 is an upper isometric view of aspects of the second embodiment of a casing driver.

FIG. 18 is an upper isometric view of aspects of casing driver 102. In FIG. 18, a spacer 160 is positioned between casing interface 120 and cone 62. In operation, the spacer 160 is a removable piece that enables a drill operator to lower the casing driver 102 onto the spacer 160 to place it into a resting position so that support personnel can either unbolt and remove the casing driver 102 or attach it to the drill stem 40*b*. When preparing to attach or remove the casing driver 102, posts 122 rest atop spacer 160. In this position, posts 122 do not engage cone slots 64 making the casing driver 102 easier and safer for support personnel to install casing driver 102 onto drill stem 40*b* or remove casing driver 102 from drill stem 40*b*.

Figure 19:
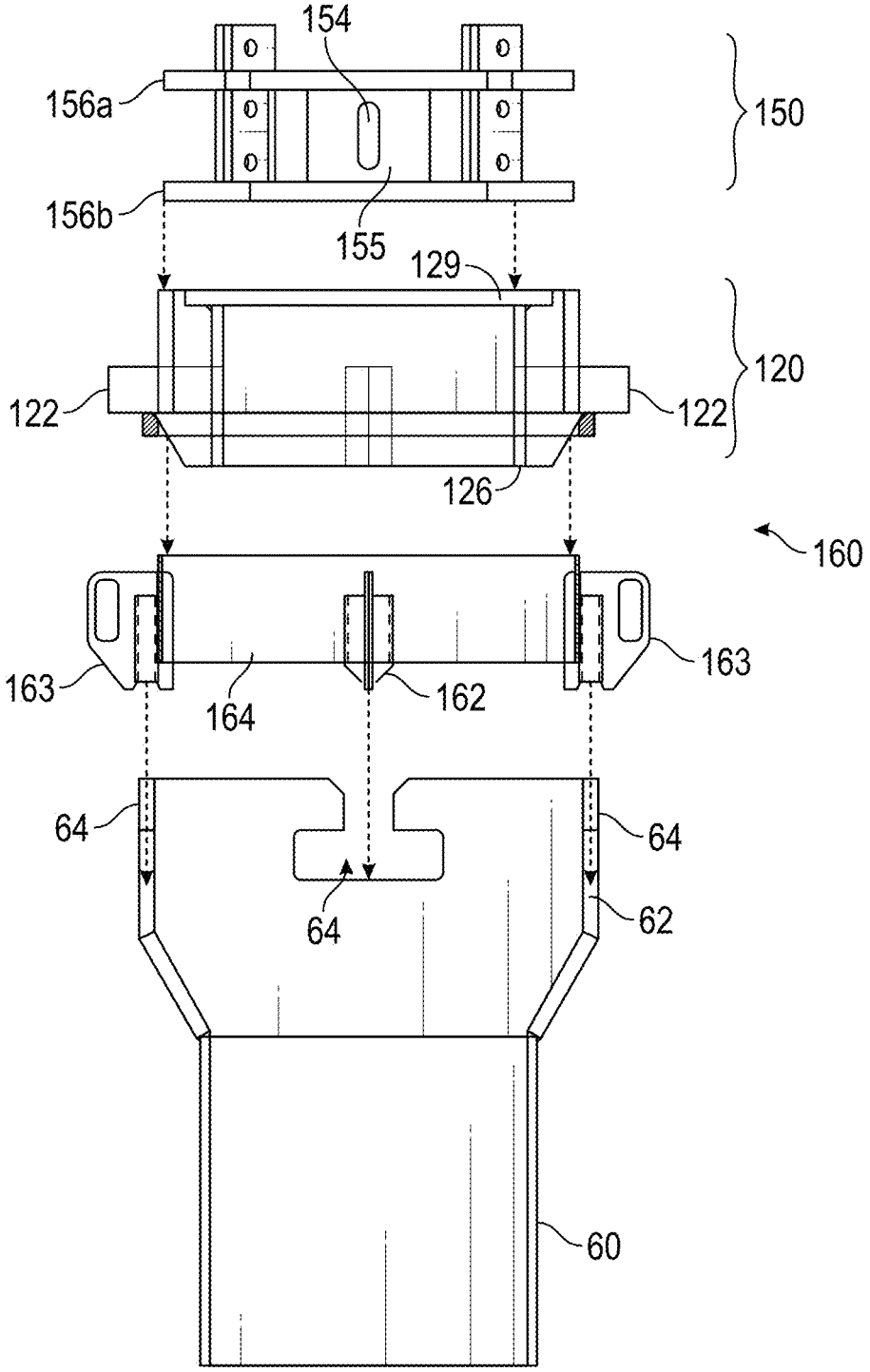
FIG. 19 is a side view of the second embodiment of a casing driver.

FIG. 19 is a side view of the casing driver 102 with optional spacer 160. In FIG. 19, casing interface 120 is shown to include an additional flange 129 atop inner ring sections 126. Flange 129 may be split like rings 124, 126 to provide two identical halves. Flange 129 may be used to provide additional contact area for flanges 156*a*, 156*b*. Also, like flanges 156*a*, 156*b*, flange 129 is also configured to receive square drill stem 40*b* so that rotation of drill stem 40*b* is transferred to casing interface 120. As shown in FIG. 19, the taper of posts 122 may help center casing interface 120 and drill stem 40*b* within spacer 160, and, as a result, within cone 62. In turn, posts 162 and 163 are configured to fit into slots 64 so that no rotation is allowed between spacer 160 and cone 62. When spacer 160 is installed around drill stem 40*b* the casing driver 102 can rest on top of spacer 160 such that posts 122 do not engage slots 64. This helps support personnel attach and remove casing driver 102 from drill stem 40*b*. During drilling operations, spacer 160 is removed.

Figure 20:
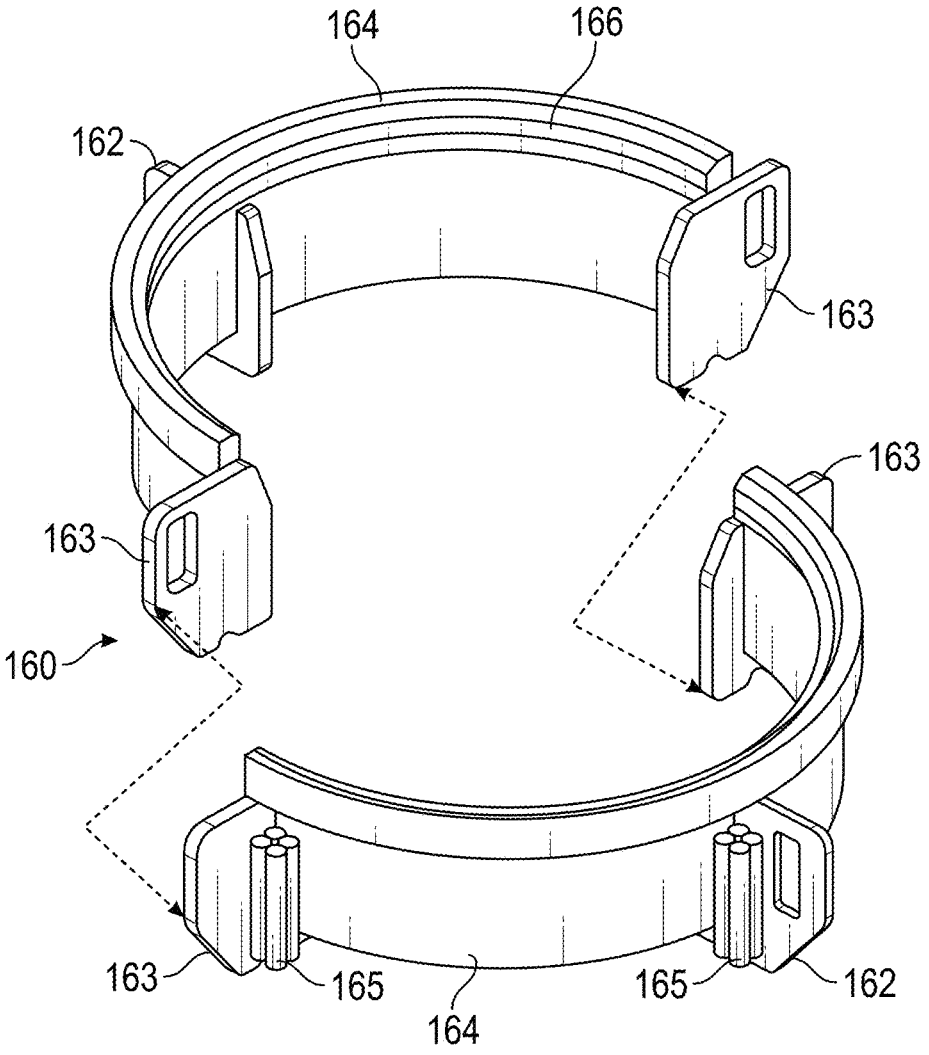
FIG. 20 is an upper isometric view of aspects of the second embodiment of a casing driver disassembled.

FIG. 20 is an upper isometric view spacer 160 disassembled. In FIG. 20, each half ring 164 of spacer 160 is shown to include posts 162 which are configured to fit into slots 64 and prevent spacer 160 from rotating relative to cone 62. In addition, each half ring 164 includes split connector plate/spacer posts 163, which, when half rings 164 are brought together, both posts 163 fit into a single slot 64 and further prevent spacer 160 from rotating relative to cone 62. Thus, in some embodiments, half rings 164 do not need to be bolted together. Spacer 160 includes a taper 166 on the upper edge of half rings 164. Taper 166 facilitates the centering of casing interface 120 into spacer 160. Spacer 160 may also include one or more centralizing bars 165 fixed to either side of post 162 and on at least one side of post 163 with an offset between the centralizing bar and the outer wall surface of half ring 14. These centralizing bars centralize spacer 160 in slot 64 and prevent posts 162 and 163 of spacer 160 from sliding out of the vertical leg of slot 64. In some embodiments posts 163 each include openings configured to bolt each half ring 164 together or to receive rigging and lifting equipment such as shackles, chains, slings or straps.

FIG. 21 is a side view of casing driver 102 including perforated spacer 130, described earlier with reference to FIG. 12. The use of perforated space 130 may be used with casing driver 102 in the manner described with reference to casing drivers 100 and 101.

In the description above, connector plates 44, connector plates 114, and fasteners were described for attaching casing driver 101 to the drill stem and slots 144, connector plates 154, and pin 146 were described for attaching casing driver 102 to the drill stem. However, in embodiments, these apparatuses for attaching a casing drive to a drill stem may each be used for any embodiment, e.g., casing driver 101 and drill stem 40*a* may be configured to use pin 146 and casing drive 102 and drill stem 40*b* may be configures to use fasteners and connector plates. Similarly, elements described with regard to one embodiment may be adapted for use with a different embodiment. For example, spacer 160 may be used with casing driver 101 as well as casing drive 102.

To facilitate an understanding of the subject matter described, many aspects are described in terms of sequences of actions. The description herein of any sequence of actions is not intended to imply that the specific order described for performing that sequence must be followed. All methods described herein can be performed in any suitable order unless otherwise indicated herein or otherwise clearly.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. For example, one skilled in the art will recognize that these embodiments can be practiced without one or more of the specific details, or with other components, systems, etc. And, in other instances, there may be structures or operations not shown, or not described in detail, to avoid obscuring aspects of the described embodiments. Therefore, the scope of the appended claims should be accorded the broadest interpretation so as to encompass all such modifications and similar arrangements.

The previous description is provided to enable any person skilled in the art to practice the various aspects described herein. In the embodiments, the separation of various system components in the embodiments described above should not be understood as requiring such separation in all embodiments. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

All structural and functional equivalents to the elements of the various aspects described throughout this disclosure that are known or later come to be known to those of ordinary skill in the art are expressly incorporated herein by reference and are intended to be encompassed by the claims.

What is claimed is:

1. An apparatus comprising:

a drive head having an attachment section configured to mount to a drill stem, the attachment section including a first attachment plate having one or more perforations, each of the one or more perforations configured to accommodate a fastener for connecting the attachment section to the drill stem;

a casing interface section connected to the attachment section such that rotation of the attachment section about an axial direction is imparted to the casing interface; and a casing, wherein when the drill stem is connected to the attachment section and the casing interface is positioned between the attachment section and the casing, a first force applied to the drill stem in the axial direction toward the casing is transmitted through the attachment section to the casing interface and to the casing.

2. The apparatus of claim 1, wherein the attachment section includes first and second parts that separate to accommodate the drill stem between the first and second parts.

3. The apparatus of claim 2, wherein joining the first and second parts about the drill stem creates a clamping force that hinders relative motion in the axial direction between the drill stem and the attachment section.

4. The apparatus of claim 1, further including the drill stem and the drill stem including a plurality of second attachment plates configured to receive the fastener, the plurality of second attachment plates distributed longitudinally along the drill stem.

5. The apparatus of claim 1, wherein the attachment section includes a first flange and the casing interface section includes a second flange, and, when the casing interface is between the attachment section and the casing, the first flange and the second flange abut each other.

6. The apparatus of claim 5, wherein the casing interface section being connected to the attachment section such that rotation of the attachment section about the axial direction is imparted to the casing interface includes the first flange and the second flange being connected to each other.

7. An apparatus comprising:

a drive head having an attachment section configured to mount to a drill stem; and a casing interface section connected to the attachment section, wherein the attachment section includes a attachment plate having one or more perforations, each of the one or more perforations configured to accommodate a pin, which when passed through any of the one or more perforations into the drill stem, hinders relative motion between the drill stem and the attachment section in an axial direction such that rotation of the attachment section about the axial direction is imparted to the casing interface section;

a casing, wherein when the drill stem is connected to the attachment section and the casing interface section is positioned between the attachment section and the casing, a first force applied to the drill stem in the axial direction toward the casing is transmitted through the attachment section to the casing interface section and to the casing.

8. The apparatus of claim 7, further including the drill stem and the drill stem including a plurality of perforations distributed longitudinally along the drill stem and configured to receive the pin.

9. An apparatus comprising:

a drive head having an attachment section configured to mount to a drill stem;

a casing interface section connected to the attachment section such that rotation of the attachment section about an axial direction is imparted to the casing interface section, the casing interface section including a first plurality of posts extending radially relative to the axial direction; and a casing, wherein when the drill stem is connected to the attachment section and the casing interface section is positioned between the attachment section and the casing, a first force applied to the drill stem in the axial direction toward the casing is transmitted through the attachment section to the casing interface section and to the casing.

10. The apparatus of claim 9, wherein the casing includes a plurality of slots configured to receive the first plurality of posts.

11. The apparatus of claim 9, wherein the casing interface section includes a flange comprised of separable first and second flange sections, a first subset of the first plurality of posts connects a first inner cylinder section to a first outer cylinder section, and a second subset of the first plurality of posts connects the second inner cylinder section to the second outer cylinder section.

12. An apparatus comprising:

a drive head having an attachment section configured to mount to a drill stem; and a casing interface section connected to the attachment section such that rotation of the attachment section about an axial direction is imparted to the casing interface section, the casing interface section includes an inner cylinder comprised of separable first and second inner cylinder sections and an outer cylinder comprised of separable first and second outer cylinder sections; and a casing, wherein when the drill stem is connected to the attachment section and the casing interface section is positioned between the attachment section and the casing, a first force applied to the drill stem in the axial direction toward the casing is transmitted through the attachment section to the casing interface section and to the casing.

13. The apparatus of claim 12, wherein the casing interface includes a flange comprised of separable first and second flange sections, the first inner cylinder section and the first outer cylinder section are connected together by the first flange section, and the second inner cylinder section and the second outer cylinder section are connected together by the second flange section.

14. An apparatus comprising:

a drive head having an attachment section configured to mount to a drill stem, the drive head further including a spacer section having a plurality of posts configured to be received by slots in a casing; and a casing interface section connected to the attachment section such that rotation of the attachment section about an axial direction is imparted to the casing interface section, wherein when the drill stem is connected to the attachment section, the casing interface section is between the attachment section and the spacer section, and the spacer section is between the casing interface section and the casing, a first force applied to the drill stem in the axial direction is transmitted to the casing through the attachment section, the casing interface section and the spacer section.

15. The apparatus of claim 14, wherein the spacer section includes a plurality of perforations.

16. A method comprising:

connecting a rotary drive of a drilling rig to a drill stem at a first longitudinal location on the drill stem, the drill stem including a drill bit at a distal end;

connecting a drive head to the drill stem at a second longitudinal location on the drill stem separated from the first longitudinal location placing a casing about the drill stem, the casing extending from the drive head toward the drill bit;

drilling a first length of a bore with the casing and drill stem moving into the bore and without relative axial motion between the casing and drill stem;

disconnecting the drive head from the drill stem; and drilling a second length of the bore with the drill stem moving axially within the casing and the casing remaining within the first length of the bore.

17. The method of claim 16, further comprising, after drilling the first length of the bore and before disconnecting the drive head from the drill stem:

connecting the rotary drive at a third longitudinal location on the drill stem separated from the first and second longitudinal locations.

18. The method of claim 16, further comprising;

pumping grout into the bore;

withdrawing the drill stem from the second length of the bore with the drill stem moving axially within the casing and the grout being pumped into the bore at a first volume flow rate that causes the grout to fill the bore to match a first withdrawal rate of the drill stem;

reconnecting the drive head to the drill stem;

engaging the drive head and the casing; and withdrawing the drill stem and casing from the first length of the bore while further pumping the grout into the bore, without relative axial motion between the casing and drill stem, and with the grout being pumped into the bore at a second volume flow rate that causes the grout to fill the bore to match a second withdrawal rate of the drill stem.

* * * * *